United States Patent [19]

Gali Mallofre

[11] 3,946,667

[45] Mar. 30, 1976

[54] SCREEN PROCESSING MACHINES

[76] Inventor: Salvador Gali Mallofre, Londres 29 1°, Barcelona, Spain

[22] Filed: Dec. 20, 1973

[21] Appl. No.: 426,698

[30] Foreign Application Priority Data

Apr. 9, 1973 Spain ..... 413513
Apr. 9, 1973 Spain ..... 413514

[52] U.S. Cl. ..... 101/123; 101/126
[51] Int. Cl.² ..... B41F 15/08; B41F 15/36
[58] Field of Search ..... 101/114, 115, 123, 124, 101/116, 126

[56] References Cited

UNITED STATES PATENTS

| | | | |
|---|---|---|---|
| 2,267,596 | 12/1941 | Montague et al. | 101/123 |
| 2,355,930 | 8/1944 | Thorne | 101/123 |
| 2,928,340 | 3/1960 | Stein et al. | 101/116 X |
| 3,106,890 | 10/1963 | Schmitt | 101/123 |
| 3,166,011 | 1/1965 | Landesman | 101/123 |
| 3,492,942 | 2/1970 | Forslund | 101/123 |
| 3,805,699 | 4/1974 | mallofre | 101/123 |

*Primary Examiner*—Edgar S. Burr
*Assistant Examiner*—R. E. Suter
*Attorney, Agent, or Firm*—Wenderoth, Lind & Ponack

[57] ABSTRACT

A screen processing machine has a frame supporting a printing screen which is capable of upward or downward movement. The frame pivots along one side thereof transverse to the longitudinal direction of transverse of a carriage, while the opposite side of the frame has lifting means provided in the carriage which are formed from two rigid laterals or sides having transverse end pieces and which form a cradle wherein the frame is situated. The frame is reinforced with two rigid heads, solidly fixed thereto at the external portion of the sides thereof transverse to the advance direction of the carriage. Such heads form elements wherein supports from which the frame is suspended are solidly fixed. The frame has parallel guides along which aligned supports slide, each one of which a vertical column which constitutes a guide element for lifting devices supporting a squeegee or stripper bridge. The lifting devices are arranged on the columns in such a way that they can be raised and lowered, the synchronous advance of the supports being independent of the columns, a rocking movement of the columns being independent of the supports, and the advance of the supports being independent of the upward and downward movements of the frame.

7 Claims, 7 Drawing Figures

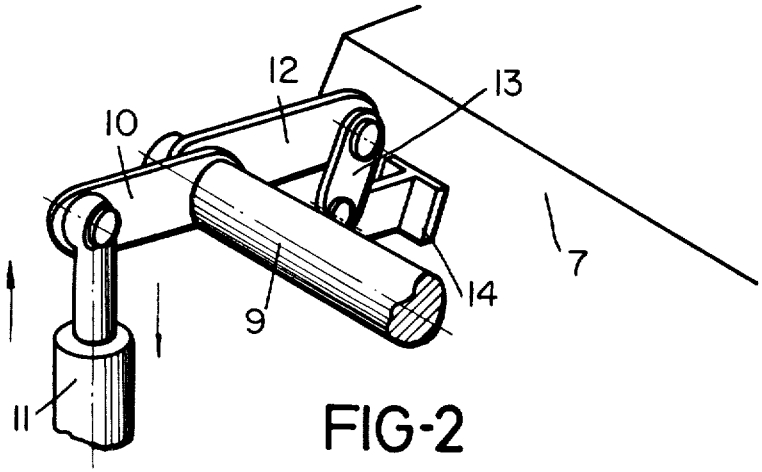
FIG-2
FIG-4
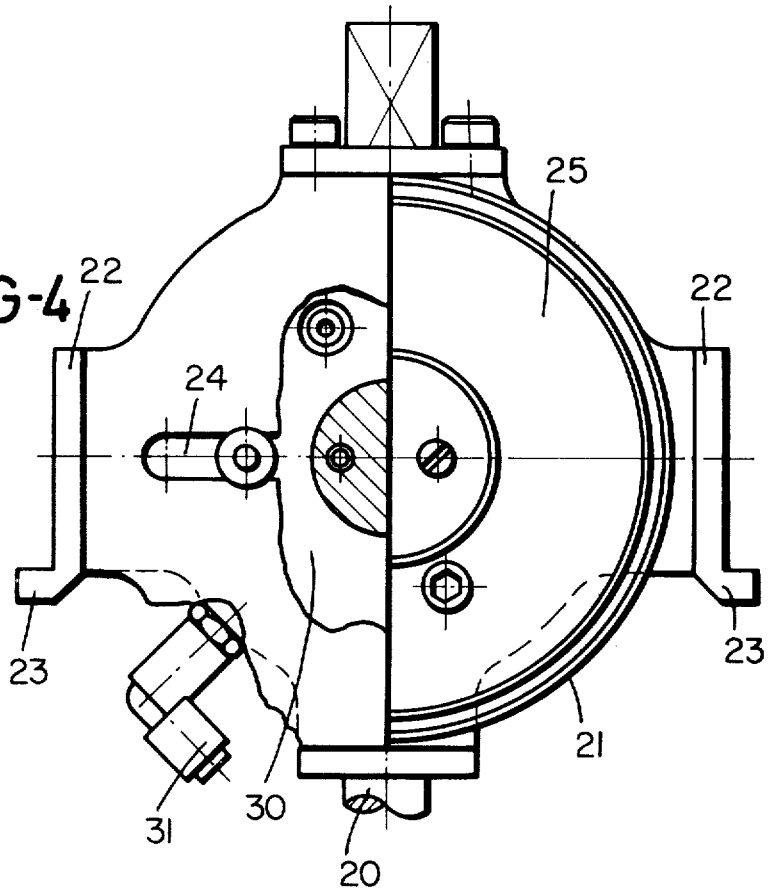

SCREEN PROCESSING MACHINES

BACKGROUND OF THE INVENTION

Screen printing machines are industrially used to decorate large flat surfaces, such as for example pieces of fabric or paper. This type of machine, due to its working efficiency and the speed with which it operates, has in many cases replaced the machines which by other means have conventionally been used for printing.

The great technological evolution of screen printing machines, up to the time of achieving their present efficiency, has been possible due to an uninterrupted succession of improvements.

Machines of this type mainly consist of a carriage which travels on guides, describing a rectilineal path on a table whereon the piece to be processed is spread and immobilized.

The piece to be processed is spread and fixed on a long table on which a carriage, guided throughout its travel, slides. Such carriage supports the printing screen and the elements necessary to spread the screen printing inks which, through the screen, produce the decorative patterns on the piece being printed.

The carriage travels along the piece advancing in a single operative direction until the entire piece has been decorated.

The screen printing ink which impregnates the piece to be printed, thus producing the designs composing the decorative patterns, is spread in the interior of the screen.

Since a separate screen is needed to apply each one of the colors which adorn the piece, the machine will make as many movements or productive passes on the piece to be printed as the number of different colors to be applied to the piece.

The screen is lowered at each stop and is superficially coupled to the piece to be printed. Once the screen printing ink is spread, the screen is raised and thus separated from the piece, and the carriage is advanced to another station.

Heretofore, spreading of the ink has been achieved by means of an arm which, provided with a squeegee or stripper, makes a tracking movement, thus spreading the ink over the screen and through the perforations therein.

Since an unproductive return movement is necessary with each productive printing movement, and since each productive printing movement comprises a plurality of screen processing application stops or stations, it is understood that one of the most important factors of the production yield of such machines is the speed with which the machine travels.

On the other hand, bearing in mind that one of the restrictions on the velocity of screen printing, and therefore on the yield of the machine involves the dimensions of the screen, it will also be understood that manufacturers always attempt to increase the size of the screen carriers used in their machines. However, when the dimensions of the screen are increased, the arm bearing the squeegee or stripper becomes in turn so supersized that its working efficiency is remarkably reduced, to such an extent that the inferior quality of the printed pieces is not permissible.

Just as important as the above mentioned factors on the yield of the machine, is the driving speed of the screen printing application means and the dimensions of the screen.

The automatic mechanisms which cause the carriage to travel and the devices used for screen printing application have been so improved that the working speeds thereof have reached their maximum.

The dimensions of the screen are determined by the width of the piece and the length of the pitch or repetition of the design.

The screens have heretofore covered a surface which comprises the width of the piece and a pitch or a complete portion of the design constituting the pattern with which the piece is decorated.

According to the above, it can be seen that the screen can be supersized only in a single direction, since the width of the piece determines the other, which is invariable. Consequently, the screen can only be supersized by increasing its length, which corresponds to the direction of the warp of the piece. However, this increase should, as a minimum, comprise a complete unit or a pitch of the design, whereby a new screen, which would be double or triple the size of a conventional screen would be obtained.

On increasing the dimensions of the screen, lengthening it in the direction of the warp, the application stops or stations are reduced to a half, a third or a quarter, according to the rate of increase, whereby the unproductive intervals of the machine are partially reduced.

A screen having the described features should be stronger than the conventional, since it will be heavier and would require strong and efficient movement producing members, in order to maintain the same working speed.

On the other hand, the means used to spread the printing ink, which in a conventional screen operates in the direction of the weft of the piece, since this is the largest part of the frame, cannot in the new screen operate in the same direction, since the smallest part of the new screen corresponds precisely to the largest part of the other. Consequently, the size, weight and characteristics of the spreading means as well as the strength and weight of the mechanisms operating the same, are greater than in a conventional machine.

All these conditions prevent the occasional modification of a conventional machine, to such an extent that even though its function is identical and the principle by which it develops is maintained constant, the machine evolves and is improved in such a way that it is different.

SUMMARY OF THE INVENTION

The improvements of the screen printing machine according to the invention, are fundamentally involved:

— in the frame which supports the screen

— in the carriage which supports the frame

— in the means used to connect the screen to the surface of the piece to be printed, or disconnect the same therefrom; and — in the screen printing appliers.

It can be seen from the above mentioned facts, that the technical solutions adopted to achieve the improvements of the present invention cannot be applied indistinctly since they are so intimately related, inasmuch as one is a result of the other, that they constitute a whole, whose introduction to a conventional screen printing machine would imply the modification of all the structural elements thereof, giving rise to a different and novel invention.

In the embodiment to be described, the frame which supports the screen is conventional and its transversal dimensions exceed the width of the piece to be printed, while the longitudinal dimensions are larger than a complete multiple of the pitch of the design applied to the piece.

This dimensional increase permits the use of the entire work surface.

The carriage supporting the frame is comprised of two rigid sides provided with end pieces which form a cradle wherein the brackets of the frame and the frame itself are housed.

The end pieces are situated at the sides in such a way that the same are positioned on both sides of the processing table under the panel or top of the table, and fixed on the rails which guide the travel of the carriage.

The end pieces are placed transverse to the table and are arranged as a bridge thereon. Between the panel whereon the piece to be printed is placed and the bridges there is provided a space.

The frame has two rigid heads which extend transversally at the exterior portion thereof and form elements by means of which the frame is supported on the end pieces of the carriage.

The means used to raise the frame to lift it above the piece of material to be printed, as well as the means to lower the frame until the screen is superficially coupled to the flat piece of material to be printed, includes an axis of relative rotation arranged between one of the rigid heads or ends of the frame and one of the end pieces of the carriage, and an adjustable coupling including an eccentric or rocker shaft which is fixed to supports arranged on the other end piece of the carriage and which has driving arms connected thereto. A portion of the arms, which are solidly fixed to the shaft, act on a link connected to the other head of the frame, while the remaining portion of the arms are joined to traction and/or trust members for rotating the rocker shaft, thereby raising such other head of the frame. The distance between the axis of rotation and the end of the frame journaled thereon is sufficient to assure the raising of the frame with respect to the piece of material to be printed.

A lifting arm or arms, which join the rocker shaft to the frame, are diametrically arranged with respect to the driving or actuating arm or arms which are joined to the traction or thrust members which cause the shaft to turn.

Links of adjustable length are provided between pins solidly fixed to the head of the frame and to the lifting arms solidly fixed to the rocker shaft.

The traction or thrust members may be a double acting hydraulic cylinder, advantageously driven by a pneumatic converter.

Another means for driving the hydraulic cylinder would be an electric motor.

In any case, the rocker shaft is provided with means which determine and permit the elevation stroke of the frame to be regulated, while the minimum or rest position of the frame is maintained. These means, applied to one of the ends of the shaft, include a fixed butt or stop which determines the maximum drop of the frame, and a movable stop or butt which determines the upstroke of the frame. Both stops or butts are contacted by edges of an eccentric profile integral with the rocker shaft, or by teeth emerging therefrom.

The movable stop or butt is radially arranged with respect to the rocker shaft, and is solidly fastened to a fixed arm of a shaft which is provided with interlocking means which permit the shaft to be fixed in any one of various adjustable positions circumferentially of the rocker shaft.

Elements capable of controlling the hydraulic cylinder are solidly fixed to the stops of butts. However, should the cylinder be activated by a pneumatic converter, then pneumatic valves, which could be replaced by contacts in case the cylinder is actuated by an electromotor, will be used.

Between the end pieces wherein the rocker shaft and the head of the frame are housed there are provided lateral guide means capable of avoiding pitches in the lowering or raising of the frame.

The frame supporting the screen is provided with two side races along which supports to which a squeegee or stripper bridge is fixed slide. The bridge is arranged on lifting devices so that upward and/or downward movements thereof are possible along rockable columns, each of which extend from one of the supports which will always be in alignment with the other. The supports move synchronously along parallel guides which comprise the races, and this movement is independent of the rocking or tilting of the columns, which rocking is also independent of the synchronized raising and lowering of the lifting devices supporting the bridge.

The lifting devices of the squeegee or stripper bridge include a central body provided with a longitudinal chamber wherein a hollow piston is housed. Such piston is urged toward one end of the chamber by a spring to raise the lifting device body with respect to the column.

Each one of the lifting devices, parallel to the longitudinal chamber, has external and parallel vertical guides ending in lower projections. Such guides along their surfaces have one or more orifices through which may be outwardly urged bolts by the selective activation of a cam-controlling knob positioned on the external front surface of each one of the lifting devices.

Each one of the supports includes a frame wherein a double acting pneumatic cylinder is provided with independent chambers within which moves a piston. The piston has therein a housing containing the lower end of a column which is pivoted to the support at an intermediate point thereof.

The base of each support is provided with lateral plates which cover the guide on which the support is mounted. The lateral plates are provided with races which act on the lower surface of the races constituting the guide.

The chambers of each of the supports are connected to each other in such a way that the movements of the pistons therein are simultaneously and synchronously produced.

The hollow piston within the longitudinal chamber of each lifting device of the squeegee or stripper bridge forms a housing covering the column of the respective support. The hollow piston forms a fixed assembly over which the body of the lifting device travels, dependent upon volumetric variations created in a compression chamber constituted by the face of the hollow piston and the walls of the longitudinal chamber itself. The fluid injection elements of the compression chambers of both lifting devices are synchronized so that fluid admission or removal from such chambers are produced in unison whereby the lifting devices and the bridge supported thereby move synchronously.

The ends of the squeegee or stripper bridge have side flanges the internal surfaces of which are dimensioned to fit the vertical guides of the lifting devices, sliding thereon until the same contact the guide projections. Each of the flanges are provided with orifices positioned to correspond with the outward path of movement of the bolts, thus constituting housings wherein the bolts are housed in their maximum outer positions.

The screen frame of the screen printing machine will be provided with two lateral races, along which slide the supports supporting the lifting devices of the squeegee or stripper bridge and the bridge itself, so that the bridge will be transversally arranged with respect to the screen, and its upward and downward movement capability will permit the bridge to contact and/or exert pressure on and even be raised above the screen.

Due to the parallel arrangement of the squeegee or stripper with respect to the screen mold, to the rigid structure of the bridge, and to the uniform pressure exerted by the pneumatic chambers of the lifting devices on extreme opposite points of the bridge, it is understood that the pressure of the squeegee or stripper is uniform throughout its length, and therefore that spreading of the printing ink is effected under optimal conditions.

The advance of the squeegee or stripper is effected, for example, by means of endless chains solidly fastened to the supports and driven by means such as a reversible motor.

BRIEF DESCRIPTION OF THE DRAWINGS

The above will become more apparent with the help of the attached drawings which, together with the following detailed description, illustrate an exemplified, but not limiting, embodiment of the invention.

FIG. 2 is an enlarged perspective view of the rocker shaft, the arms, the plunger and the link which fastens one of the arms to one end of the frame.

FIG. 4 is an elevational view, partically in section, of one of the squeegee bridge lifting devices coupled to a column which is carried by a movable support.

DETAILED DESCRIPTION OF THE INVENTION

Figure 1:
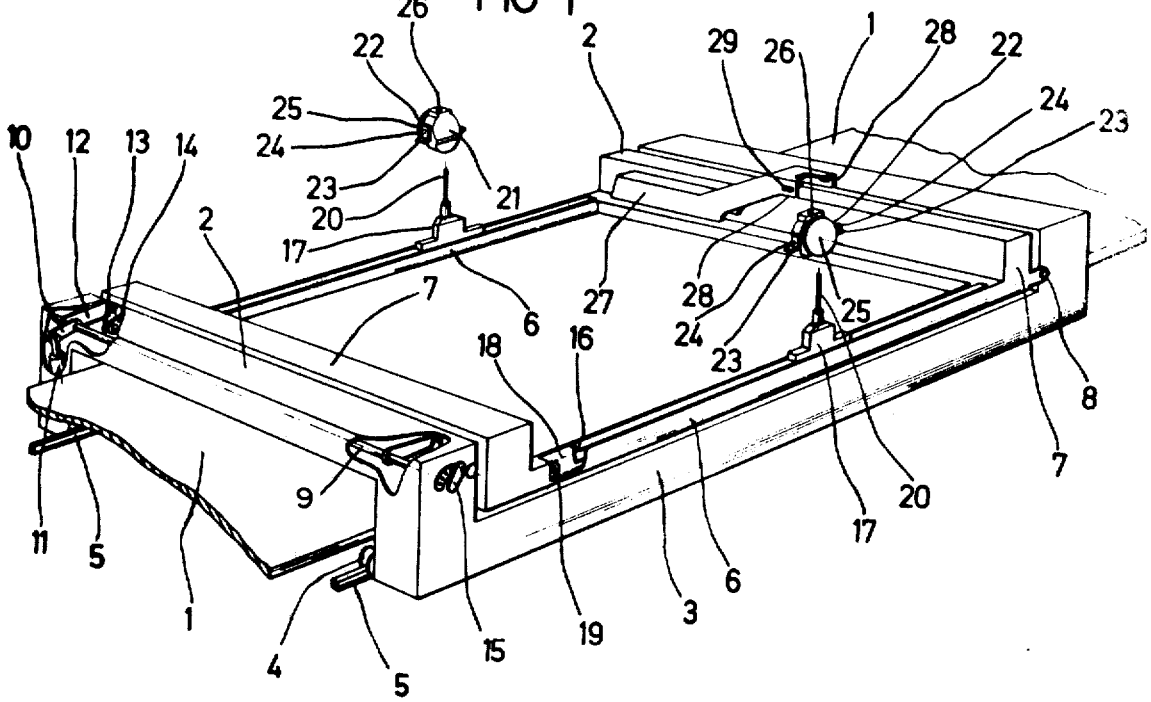
FIG. 1 is a perspective view schematically representing a screen processing machine in accordance with the present invention. Logically, the drawings do not illustrate the blade of the squeegee or stripper, the screen, or the driving elements of the machine, since such elements do not constitute the invention and may be any conventional such elements. These elements therefore also have not been described in the specification. The partial cut-away views have been made in FIG. 1 to simplify the same and to represent elements which would otherwise be concealed.

With reference particularly to FIG. 1, there is shown a sheet of material 1 to be printed and positioned on a processing table (not shown), a carriage which moves along the table, end pieces 2 of the carriage, lateral sides 3 of the carriage, rollers or guides 4 of the carriage, guide rails 5 on the table and along which move guides 4 of the carriage, a screen supporting frame 6, upwardly extending ends 7 of the frame. One of the ends 7 of the frame 6 is pivotally supported at 8 to one end piece 2 of the carriage. A rocker shaft 9 is pivotally supported in the other end piece 2 of the carriage and has arms 10 and 12 fixed thereto. Movement of fluid cylinder 11 rotates shaft 9 which lifts the other end 7 of frame 6 by means of connecting link 13 and bracket or arm 14 connected to such other end 7. An adjustable stop 15 controls the amount of rotation of shaft 15, and thus the degree of lift of such other end 7 of frame 6. Rails 16 are provided along the sides of frame 6, and along which a pair of movable supports 17, which spport a squeegee or stripper bridge 27, slide. Supports 17 are fixed to endless chains 18 which are reversibly moved in unison by drive means such as a motor with a shaft and sprockets 19. Each support 16 has a column 20 extending upwardly therefrom and supporting a lifting device 21 which supports an end of bridge 27. Each device 21 has opposite vertical external guides 22 for supporting the bridge and lower projections 23 for support thereof. Each device 21 has a control knob 25 which controls a cam which pushes bolts 24 outwardly of the device into housings or openings 29 in opposite side flanges 28 of bridge 27, to thereby hold bridge 27 in place on lifting devices 21. Retraction of bolts 24 by control knob 25 allows bridge 27 to be removed from lifting device 21.

Referring to FIG. 2, the arrangement for lifting the screen frame 6 is shown in more detail. Rocker shaft 9 has fixed thereto driving arm 10 and lifting arm 12. Hydraulic cylinder 11 reciprocates arm 10 and thus shaft 9 and lifting arm 12, which lifts link 13 which lifts arm 14 which is connected to one end 7 of frame 6. Thus, this end of frame 6 may be lifted and lowered, the frame 6 thus pivoting at the other end thereof about pivot 8.

Figure 3:
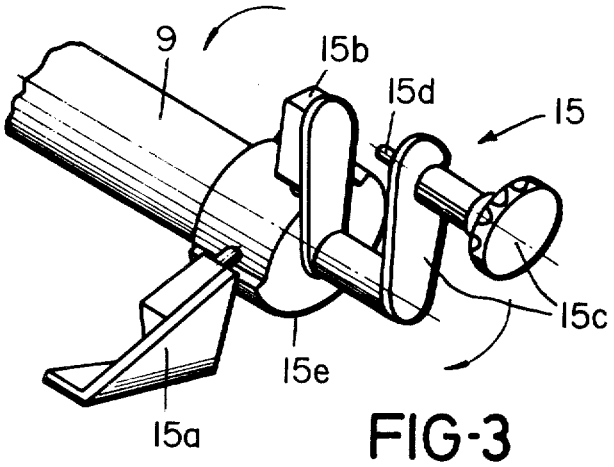
FIG. 3 is an enlarged perspective view of the rocker shaft and stops thereof which regulate and control the plunger.

Referring to FIG. 3 the device for controlling the degree of rotation of shaft 9 is shown in more detail. This device 15 includes a fixed stop 15*a* and an adjustable stop 15*b*, the latter being adjustable by arm 15*c* which may be locked in position by pin 15*d* adapted to engage in various openings in end piece 2 of the carriage. Shaft 9 has thereon a cylinder 15*e* with an eccentric profile having abrupt edges against which stops 15*a* and 15*b* act to limit the degree of rotation of shaft 9, and thus the height of lift of frame 6.

Figure 5:
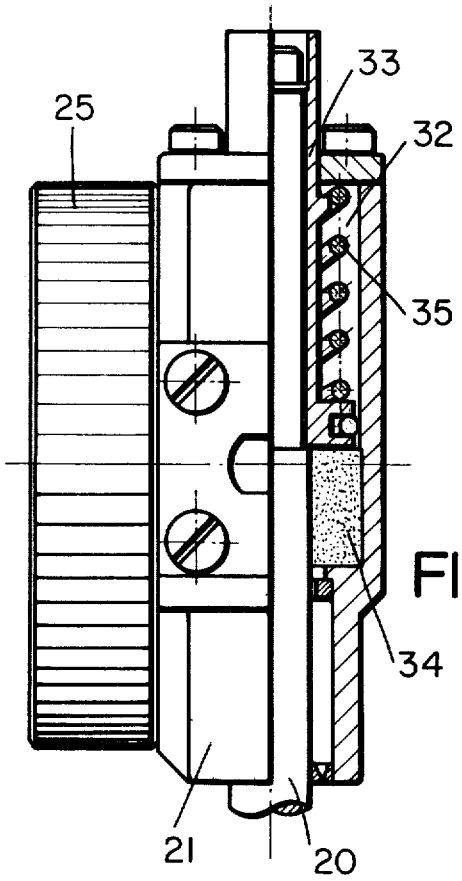
FIG. 5 is a side view, partially in section, of the lifting device represented in FIG. 4.

Referring to FIGS. 4 and 5, the construction of lifting devices 21 is shown in more detail. Each lifting device is vertically movably mounted on a column 20, and has opposite vertical guides 22 which have projections 23 for the support of the flanges of the ends of the bridge. Each device 21 has therein bolts 24 which are urged upwardly. Each device 21 has a control knob 25 with an eccentric bolt control 30 having a surface abutting bolts 24, such that selective rotation of knob 25 forces bolts 24 outwardly to thus lock bridge 27 in place on devices 21. Each device 21 has therein a longitudinal chamber housing a hollow piston 33 which surrounds a reduced diameter section of column 20 and abuts a shoulder thereon. The supply of fluid into a chamber 34 forces device 21 downwardly against the action spring 35. Thus, the bridge 27 may be lowered into contact with the screen.

Figure 6:
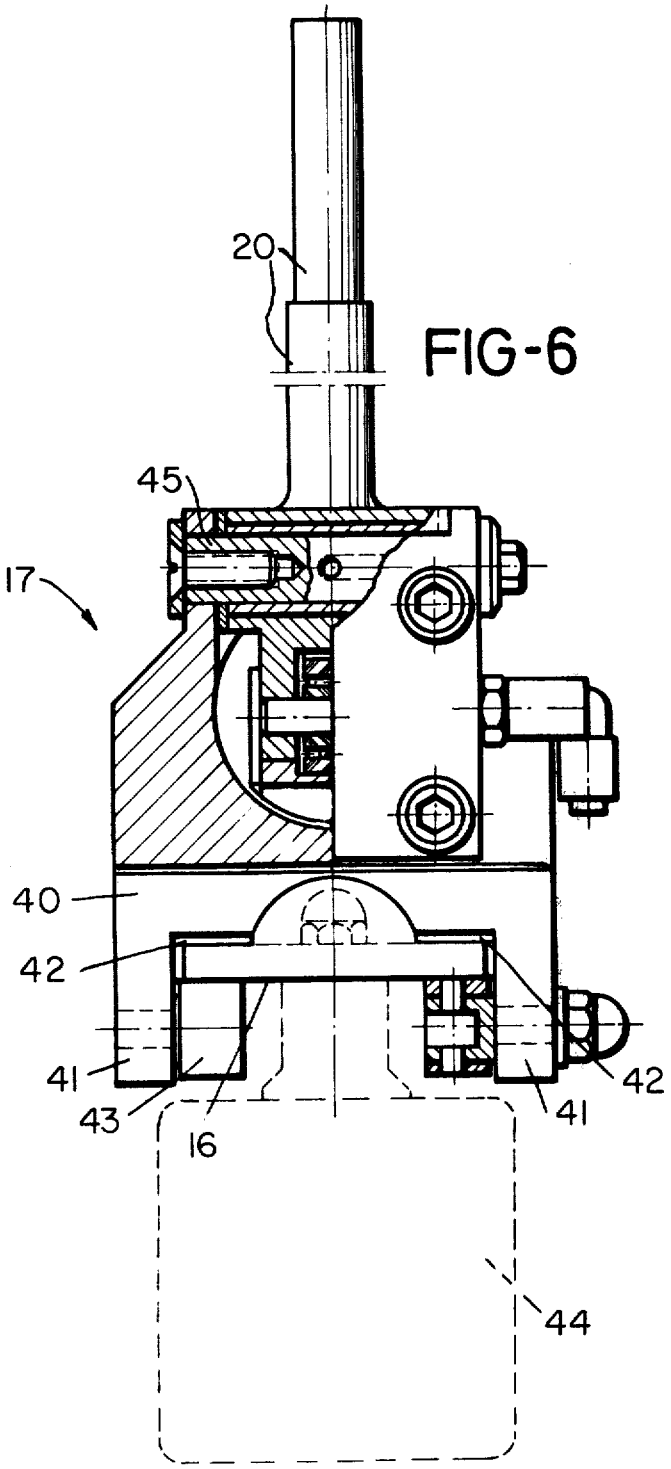
FIG. 6 is an elevational view, partially in section, of one of the supports which transports and positions the squeegee or stripper bridge along the frame.
Figure 7:
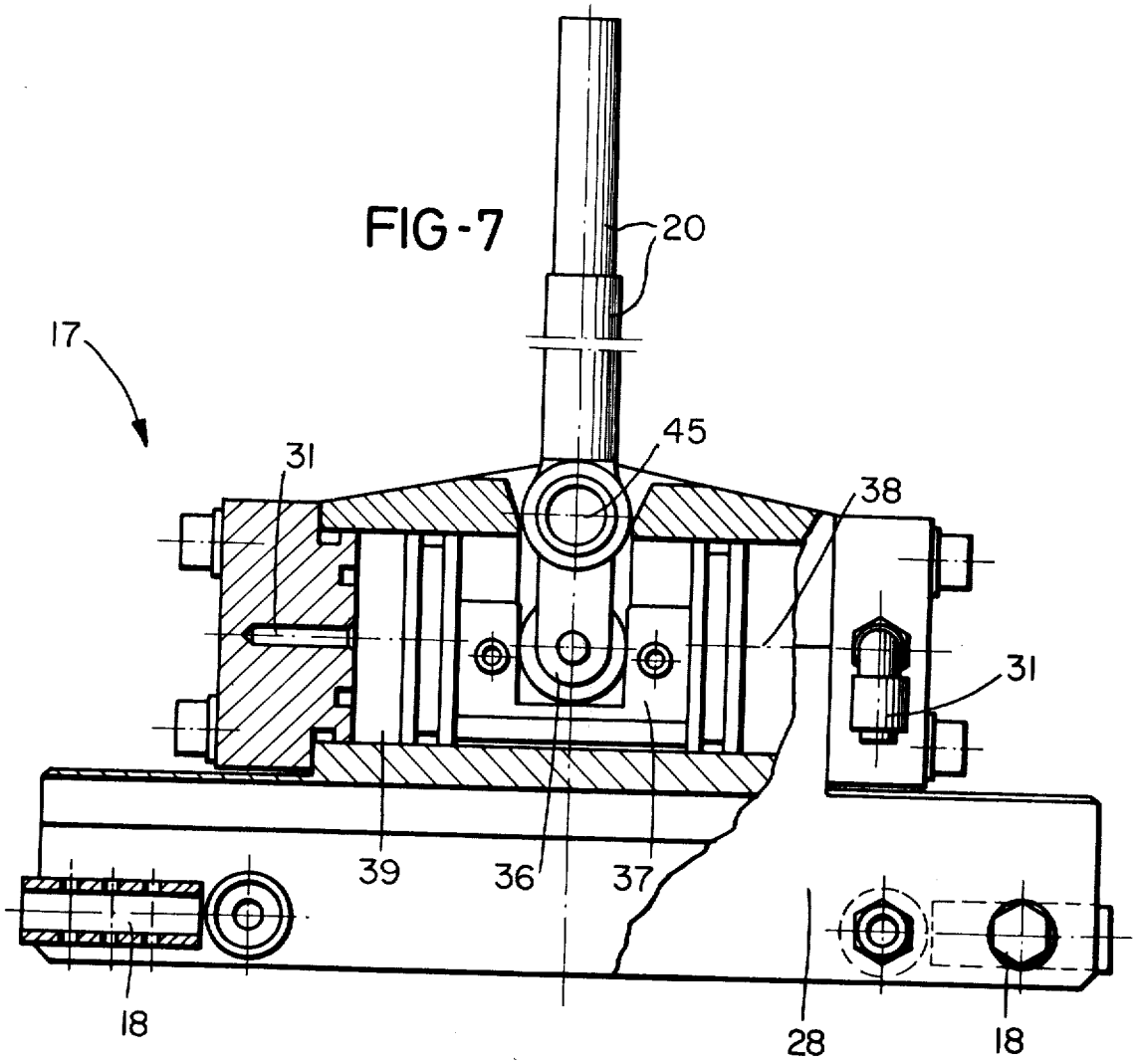
FIG. 7 is a side view, partially in section, of the support of FIG. 6.

Referring to FIGS. 6 and 7 of the drawings, a construction for pressing the squeegee of bridge 27 against the screen is shown in more detail. Movable supports 17, carrying devices 21 and bridge 27, are movable along rails 16 by means such as endless chains 18. The column 20 is pivoted to support 17 about a transverse horizontal axis 45. The end 36 of column 20 has a roller thereon which is housed in a piston 37 which is reciprocable within a chamber within support 17. Partial chambers 38 and 39, on opposite ends of piston 37 may be selectively supplied with fluid through inlets 31, thereby moving piston 37 to the left or right as viewed in FIG. 7. Such movement causes column 20 to pivot at 45, with the result that the upper end of column 20, and thus bridge 27, will be urged toward the screen. Support 17 has a frame 40 with downwardly extending flanges 41 having thereon rollers 43 which contact the bottom of rail 16. The bottom of frame 40 has anti-friction plates 42 which contact the top of rail 16.

The operation of the device is as follows:

When the plunger of cylinder 11 pulls the driving arm 10 towards it (i.e. downwardly in FIG. 2), the rocker shaft 9 rotates, whereby lifting arm 12 lifts link 13, thus lifting the one end 7 and causing the frame assembly 6 to pivot about axis 8. The frame 6 is thus raised above the table, and the traversing movement of the carriage is facilitated. The reverse operation of cylinder 11 positions the frame 6, together with the screen which it carries, in a working position on the material 1, whereafter the ink application elements, synchronized with the stopping of the carriage and the positioning of the screen, are operated.

Stops 15*a* and 15*b* are arranged at desired positions around the eccentric profile of cylinder 15*e* solidly fixed to rocker shaft 9 to determine, according to the distance or angle separating the stops, the angular movement of shaft 9, and thus the amount of upward or downward travel of frame 6. The larger the space between the stops, the larger will be the amount of travel of the raised end of the frame.

With the bolts 24 of the lifting devices 21 retracted, the squeegee or stripper bridge 27 slides along the guides 22 of lifting devices 21 until flanges 28 rest on lower projections 23. Then knobs 25 are operated to move bolts 24 into openings 29 of flanges 28 of the squeegee or stripper bridge 27, thereby locking the bridge 27 in place on lifting devices 21.

The lifting devices 21 are supported on columns 20, and at their rest position are inoperative. That is, when the compression chamber 34 is free of fluid, spring 35 pushes lifting device 21 upwardly along column 20, thus raising bridge 27. Thereby, the particular squeegee or stripper supported by the bridge is separated from the surface on which it acts, i.e. the screen.

Simultaneous entry of fluid under pressure in the respective chambers 34 of each of the lifting devices 21 of the bridge causes compression of the springs 35, which is converted into a lowering of the lifting devices 21 and the bridge 27, until the squeegee or stripper thereof rests on the surface of the screen.

The required inclination of the squeegee or stripper, so that its action on the surface of the screen is most effective, is negative with respect to the direction of movement of the supports 17, and this inclination is determined by the action of fluid which enters the chambers 38 or 39 of the hydraulic cylinder which is positioned in each one of the supports 17 and which controls the column 20 on which the corresponding lifting device 21 is supported.

The advance of the supports by means of the chains 18 is initiated simultaneously with the inclination movement of the columns. Further, stopping of supports 17, before their movement in the opposite direction is initiated, coincides with the lifting of the bridge, inclination of the columns in the opposite direction, and a further lowering of the bridge.

All these movements may be effected automatically and are synchronized with the movements of the other elements of the screen processing machine, so that together therewith they constitute an efficient assembly which carries out its function without the intervention of normal operations, without mistakes or errors, and with greater speed, all without impairing the quality of screen printing.

In addition to the extensive increase in the production capacity of the printing machine, the above improvements of the invention permit the frame to be of such a size that the screen housed therein is capable of covering, at the same time, an entire piece to be printed, for example a table cloth, a bedspread, or a curtain, which possibility has heretofore been impossible with conventional machines.

I claim:

1. In a screen printing machine of the type including a table or platform for positioning thereon of a longitudinally extending piece of material to be printed; a carriage mounted for longitudinal movement along said table; a frame having a flat screen thereon and mounted on said carriage; means for selectively raising and lowering said frame with respect to said carriage to bring said screen out of and into contact with a piece of material positioned on said table; a squeegee or stripper; and means mounting said squeegee or stripper for selective movement over said screen to force printing ink therethrough and onto a piece of material positioned on said table; the improvement wherein:

said carriage comprises a member having opposite lateral sides movably mounted on said table on opposite sides of said piece of material positioned thereon, and opposite ends joining said lateral sides and extending transversely thereto at a spaced above said table;

said frame has opposite lateral sides and opposite ends, a first of said ends being hingedly connected to a first of said opposite ends of said carriage about an axis parallel thereto;

said raising and lowering means comprises coupling means interconnecting a second of said frame ends with a second of said opposite ends of said carriage, said coupling means comprising a rocker shaft rotatably journaled in said second carriage end and extending parallel thereto; at least one driving arm integral with said rocker shaft; at least one lifting arm integral with said rocker shaft; link means for connecting said lifting arm and said second frame end; and reciprocating means connected to said driving arm for reciprocating said driving arm and said rocker shaft about the longitudinal axis of said rocket shaft, and for thereby reciprocating said lifting arm and said link means and thus raising and lowering said second frame end;

said squeegee movement means comprises rails on said opposite lateral sides of said frame; a support mounted on each of said rails; means for moving said supports synchronously along said rails; a lifting device operatively connected to each of said supports for synchronous vertical movement with respect thereto; and a bridge having connected thereto said squeegee or stripper and having opposite ends, one each in gripping engagement with one of said lifting devices; and means for adjustably regulating the amount of lift of said second frame end with respect to said carriage, said regulating means comprising a cylinder integral with said rocker shaft; said cylinder having an eccentric profile providing two abrupt edges; a fixedly mounted stop positioned to be engaged by a first of said abrupt edges; and an adjustably mounted stop mounted to be engaged by a second of said abrupt edges, the position of said adjustably mounted stop with respect to the circumference of said rocker shaft being variable.

2. The improvement claimed in claim 1, wherein each of said supports has extending upwardly therefrom a column; each of said lifting devices comprises a body member having a longitudinal passage extending therethrough, each of said longitudinal passages receiving one of said columns.

3. The improvement claimed in claim 2, wherein each of said columns has adjacent the upper end thereof a radial annular shoulder; and each said lifting device further comprises an internal chamber within said body member and communicating with said longitudinal passage, a hollow piston in said internal chamber surrounding said column and abutting said shoulder, and a spring acting on said piston and said body member and urging said body member upwardly with respect to said column.

4. In a screen printing machine of the type including a table or platform for positioning thereon of a longitudinally extending piece of material to be printed; a carriage mounted for longitudinal movement along said table; a frame having a flat screen thereon and mounted on said carriage; means for selectively raising and lowering said frame with respect to said carriage to bring said screen out of and into contact with a piece of material positioned on said table; a squeegee or stripper; and means mounting said squeegee or stripper for selective movement over said screen to force printing ink therethrough and onto a piece of material positioned on said table; the improvement wherein:

said carriage comprises a member having opposite lateral sides movably mounted on said table on opposite sides of said piece of material positioned thereon, and opposite ends adjoining said lateral sides and extending transversely thereto at a position spaced above said table;

said frame has opposite lateral sides and opposite ends, a first of said ends being hingedly connected to a first of said opposite ends of said carriage about an axis parallel thereto;

said raising and lowering means comprises coupling means interconnecting a second of said frame ends with a second of said opposite ends of said carriage;

said squeegee movement means comprises rails on said opposite lateral sides of said frame; a support mounted on each of said rails; means for moving said supports synchronously along said rails; a lifting device operatively connected to each of said supports for synchronous vertical movement with respect thereto; and a bridge having connected thereto said squeegee or stripper and having opposite ends, one each in gripping engagement with one of said lifting devices, said ends of said bridge having a substantially inverted U-shaped cross-sectional configuration with downwardly depending flanges, each of said flanges having an orifice therein; and each of said lifting devices have therein selectively retractible bolts; and means connected to said bolts for selectively moving said bolts to and from a retracted position wherein said bolts are within said lifting devices from and to a second position wherein said bolts extend outwardly from said lifting devices into said orifices in said flanges of said bridge, thereby locking said bridge in position on said lifting devices.

5. The improvement claimed in claim 4, wherein each of said supports has extending upwardly therefrom a column; each of said lifting devices comprises a body member having a longitudinal passage extending therethrough, each of said longitudinal passages receiving one of said columns.

6. The improvement claimed in claim 5, wherein each of said columns has adjacent the upper end thereof a radial annular shoulder; and each said lifting device further comprises an internal chamber within said body member and communicating wtih said longitudinal passage, a hollow piston in said internal chamber surrounding said column and abutting said shoulder, and a spring acting on said piston and said body member and urging said body member upwardly with respect to said column.

7. In a screen printing machine of the type including a table or platform for positioning thereon of a longitudinally extending piece of material to be printed; a carriage mounted for longitudinal movement along said table; a frame having a flat screen thereon and mounted on said carriage; means for selectively raising and lowering said frame with respect to said carriage to bring said screen out of and into contact with a piece of material positioned on said table; a squeegee or stripper; and means mounting said squeegee or stripper for selective movement over said screen to force printing ink therethrough and onto a piece of material positioned on said table; the improvement wherein:

said carriage comprises a member having opposite lateral sides movably mounted on said table on opposite sides of said piece of material positioned thereon, and opposite ends joining said lateral sides and extending transversely thereto at a position spaced above said table;

said frame has opposite lateral sides and opposite ends, a first of said ends being hingedly connected to a first of said opposite ends of said carriage about an axis parallel thereto;

said raising and lowering means comprises coupling means interconnecting a second of said frame ends with a second of said opposite ends of said carriage;

said squeegee movement means comprises rails on said opposite lateral sides of said frame; a support mounted on each of said rails; means for moving said supports synchrnously along said rails; a lifting device operatively connected to each of said supports for synchronous vertical movement with respect thereto; and a bridge having connected thereto said squeegee or stripper and having opposite ends, one each in gripping engagement with one of said lifting devices; and each of said supports comprises a body; a column extending upwardly from said body, one of said lifting devices being vertically movably mounted on said column; and means for tilting said columns about an axis parallel to the longitudinal dimension of said bridge to selectively press said squeegee or stripper attached to said bridge against said screen, said means for tilting comprising a chamber within each said support body, a piston mounted within said chamber for movement between partial chambers on opposite sides thereof, means connected to said partial chambers for selective pressurization thereof for selective movement of said piston, a roller connected to the lower end of each said column and positioned in the respective said piston, and means pivotally connecting each column at a position between the opposite ends thereof to the respective said support body for pivoting movement about said axis parallel to the longitudinal dimension of said bridge.

* * * * *